US006181236B1

(12) United States Patent
Schneider, Jr.

(10) Patent No.: US 6,181,236 B1
(45) Date of Patent: Jan. 30, 2001

(54) SPORTS WHISTLE WITH AUDIBLE AND VISUAL OUTPUT SIGNALS

(76) Inventor: Arnold C. Schneider, Jr., 723 Clovelly La., Devon, PA (US) 19333

( * ) Notice: Under 35 U.S.C. 154(b), the term of this patent shall be extended for 0 days.

(21) Appl. No.: 09/454,728

(22) Filed: Dec. 4, 1999

(51) Int. Cl.[7] ..... G08B 27/00

(52) U.S. Cl. ..... 340/326; 340/539; 340/332; 340/323 R

(58) Field of Search ..... 340/539, 573.1, 340/326, 323 R, 332, 321

(56) References Cited

U.S. PATENT DOCUMENTS

| | | | |
|---|---|---|---|
| 4,314,316 | 2/1982 | Gertler et al. | 362/86 |
| 5,293,354 | 3/1994 | Costabile | 368/11 |
| 5,507,246 | 4/1996 | Rand | 116/137 R |
| 5,847,652 | 12/1998 | Yamamoto | 340/574 |
| 6,067,013 * | 5/2000 | Pejic | 340/539 |

* cited by examiner

*Primary Examiner*—Daryl Pope

(57) ABSTRACT

A sports whistle having a sensor (12) which is responsive to the operation of a present art whistle (14). Said sensor activates a conventional wireless transmitter (18) simultaneously with the audible output signal. Said wireless signals are acquired by a conventional receiver (28). Said receiver initiates a variety of visual indicators to overcome crowd noise.

6 Claims, 3 Drawing Sheets

SPORTS WHISTLE WITH AUDIBLE AND VISUAL OUTPUT SIGNALS

BACKGROUND—FIELD OF THE INVENTION

This invention relates to whistles used by officials at sporting events to indicate the occurrence of some event. In particular, it provides the improvement of simultaneous audible and visual signals to overcome noise.

BACKGROUND—DESCRIPTION OF INVENTION

In many sports such as football, soccer, basketball, ice hockey, wrestling, etc., an official blows a whistle to notify players and spectators of the occurrence of some event. Due to increased crowd noise, it is often impossible for live spectators at a stadium and television viewers at home to discern the audible signal and to know when the event occurred. It is, therefore, proposed that these officials use a conventional whistle to initiate a wireless signal simultaneous with, and in the same manner as, the present art, audible signal. By means of a receiver, this wireless signal is then used to initiate a variety of visual signals that can easily be discerned by both live spectators and television viewers. If desired for security, the wireless signal can be comprised of several frequencies.

Football is an excellent example for the usage of this improvement. When a referee signals that a play has ended, the audible signal usually can not be heard by the crowd in attendance or by the television audience. If the ball is subsequently fumbled, it is difficult to know whether the whistle was blown before or after the fumble. With this improvement, when the whistle is blown, a simultaneous wireless signal initiates a variety of lights or other visual indications on the playing field and also on the television screen. By use of video replay, it is then possible to determine exactly when the referee's signal was made.

PRIOR ART

There have been toy and party whistles with extension elements that give a visual indication as long as they are blown, e.g. U.S. Pat. Nos. 530,909 and 532,642. There is a sports whistle which maintains an element in the extended position after it has been blown, e.g. see U.S. Pat. No. 5,507,246. There is an illuminating whistle which has a lamp bulb within the whistle, e.g. see U.S. Pat. No. 4,314,316. There is an electronic whistle device which provides an electrically activated audible signal when a hand-held button is depressed, e.g. see U.S. Pat. No. 5,847,652.

None of the above-mentioned, prior art whistles emit a wireless signal and none of them meet the need for visual observation from a great distance or iva the television screen. In addition, the electronic whistle device does not maintain the advantages of the present art, mouth blown whistle.

OBJECTS AND ADVANTAGES

Accordingly, several objects and advantages of my invention are:

(a) to enable a sports official to give a signal which overcomes crowd noise;

(b) to maintain the present art referee whistle and its audible signal;

(c) to improve such whistles so they can provide simultaneous wireless signals;

(d) to provide a flash of light or movement of an object in the sport arena visible to entire audience that is triggered by a wireless signal from the whistle; and (e) to provide an indication on television screens that is triggered by a wireless signal from the whistle.

DRAWING FIGURE

Figure 3:
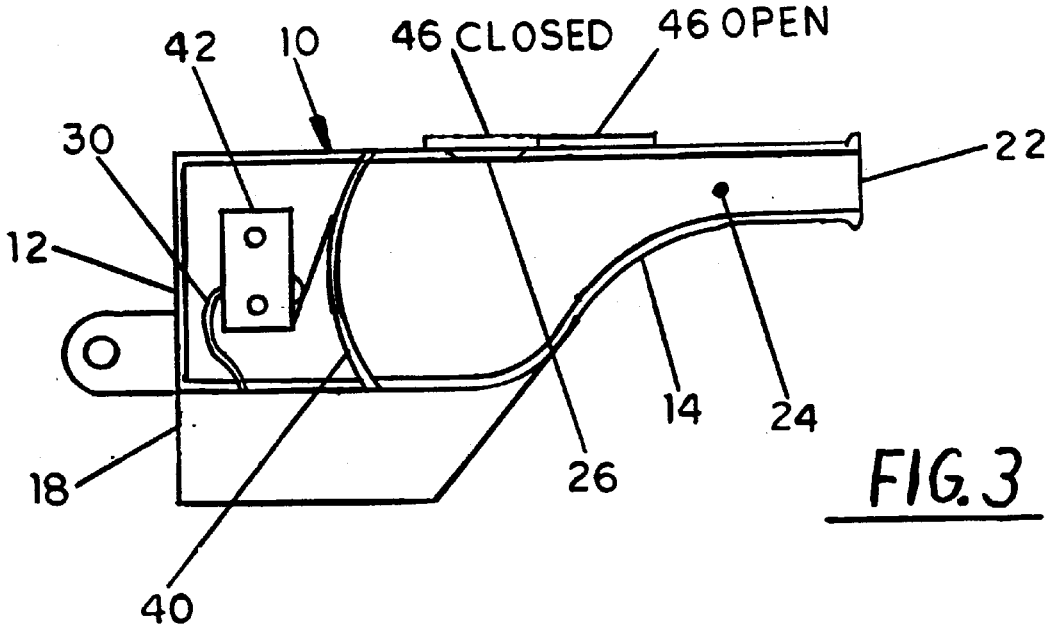
Figure 4:
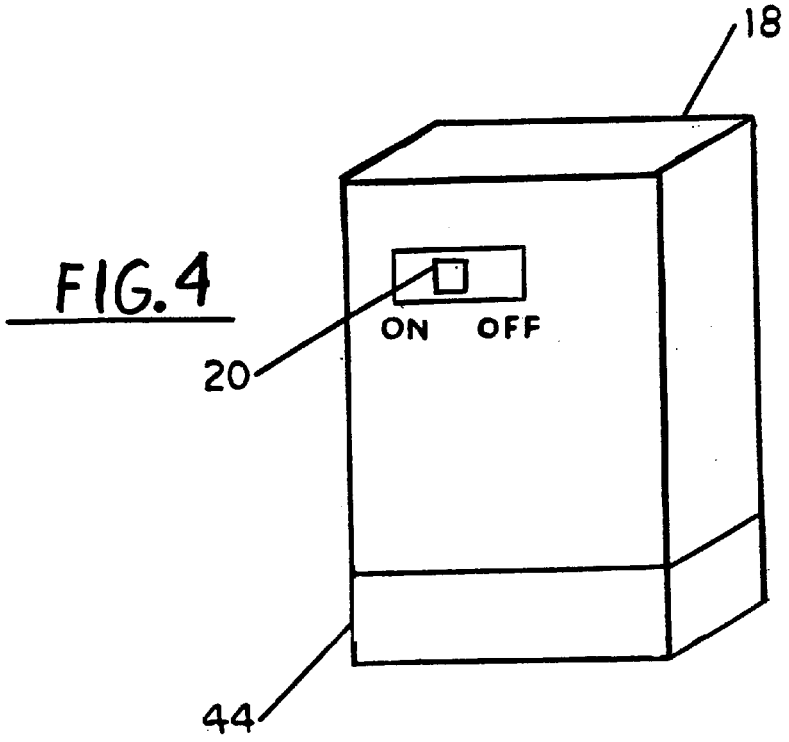

FIG. 3 depicts (a) details of the preferred embodiment of the sensor (b) details of a modification that provides a closure over the whistle opening to permit wireless signals without an audible signal (c) details of a modification wherein the transmitter is combined with the sensor and whistle in a unitary assembly FIG. 4 depicts a modification wherein the audible sensor is combined with the transmitter separate from the whistle

REFERENCE NUMERALS IN DRAWINGS

| | | | |
|---|---|---|---|
| 10 | apparatus of invention | 28 | receiver |
| 12 | sensor | 30 | wires (electrical) |
| 14 | whistle | 32 | lighting indication |
| 16 | lanyard | 34 | mech. indication |
| 18 | transmitter | 36 | T.V. indication |
| 20 | ON/OFF switch | 40 | diaphragm |
| 22 | mouthpiece | 42 | switch |
| 24 | sound chamber | 44 | audio sensor |
| 26 | opening | 46 | closure |

SUMMARY

In accordance with the present invention, a device produces a plurality of official signals at a sporting event wherein one of these signals is audible and at least one other signal is visual. In combination with a conventional whistle are a sensor, a transmitter, and a receiver.

The preferred embodiment of the invention utilizes an air-actuated sensor responsive to the whistle's operation.

An alternative embodiment of the invention utilizes an audio-actuated sensor responsive to the whistle's operation.

DESCRIPTION—FIGS. 1 TO 4

Figure 1:
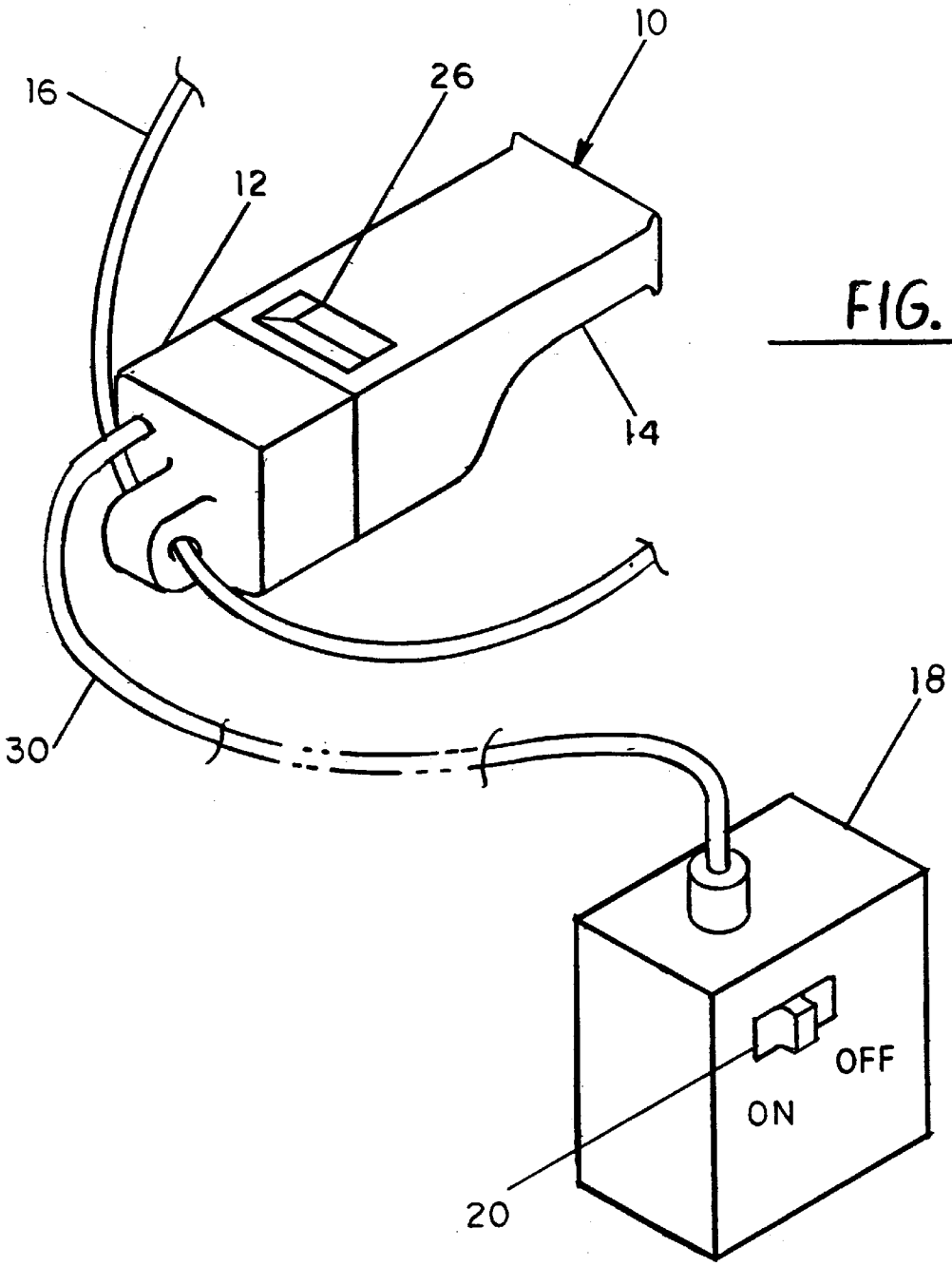
FIG. 1 depicts the preferred embodiment of the invention

The preferred embodiment of the whistle is illustrated in FIG. 1 with details of sensor 12 shown in FIG. 3. The hand-held portion of the whistle 10 is a modification of a present art referee whistle 14 by the addition of said sensor 12. The sensor 12 is connected to the pneumatics of the whistle and senses that the whistle has been blown (illustrated in FIG. 3). The sensor 12 is also electrically connected to wires 30 that go with the lanyard 16 that hangs from the referee's neck (illustrated in FIG. 1). The wires 30 connect to a conventional transmitter 18. An ON/OFF switch 20 permits audible signals with or without wireless signals.

Figure 2:
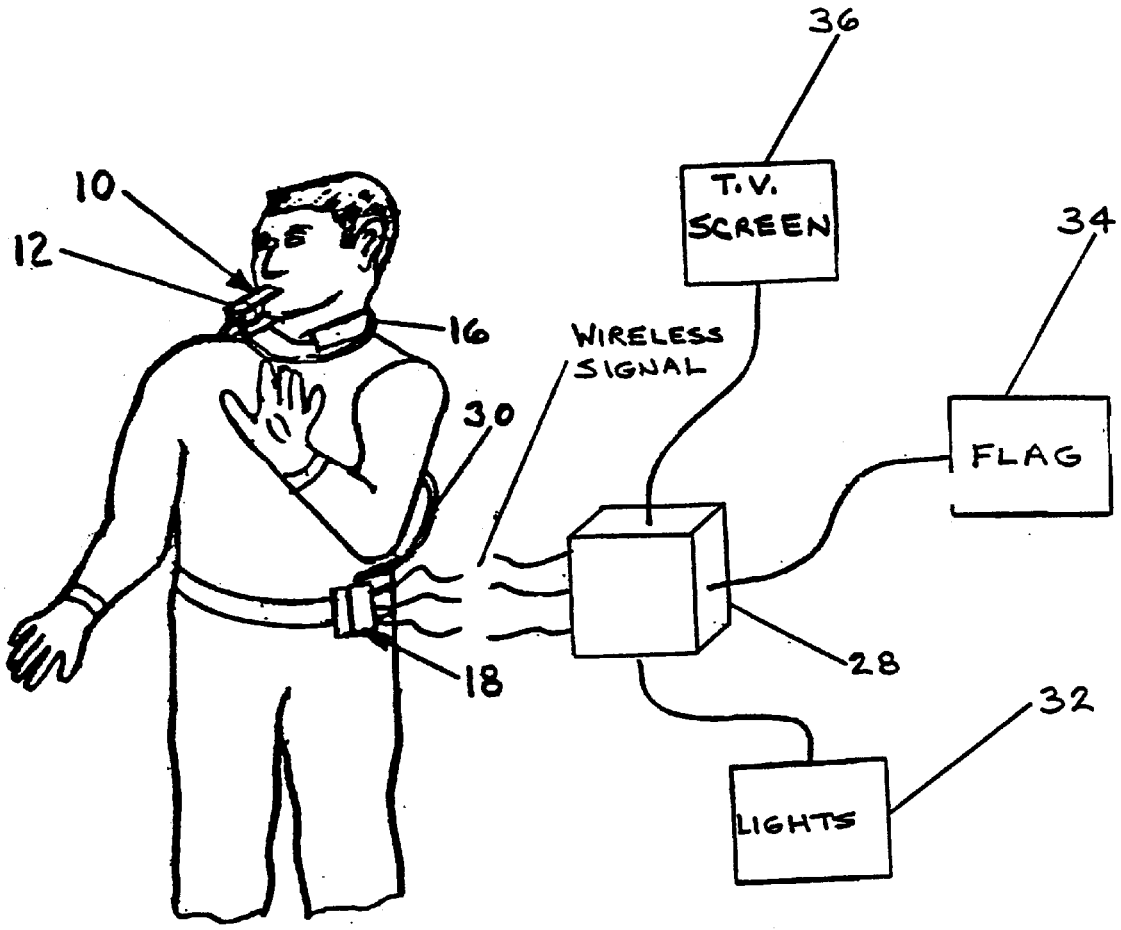
FIG. 2 is a partly diagrammatic representation of a referee using the invention to trigger remote visual signals.

The entire invention is depicted in FIG. 2. A referee is shown using the hand-held portion of the whistle 10. The transmitter 18 is attached to his waist. The two main portions are interconnected by said wires 30 that go with the lanyard 16.

FIG. 3 depicts an additional embodiment of the invention wherein the transmitter 18 is combined with the whistle 14 and sensor 12 in a unitary assembly. FIG. 3 also depicts an embodiment wherein a closure 46 can be slid over the whistle opening 26 to permit wireless signals without audible signal.

FIG. 4 depicts an additional embodiment of the invention wherein an audio sensor 44 is combined with the transmitter 18 in a unitary assembly separate from the whistle 14.

OPERATION—FIGS. 2 & 3

As shown in the figures, the operation of the audible output portion of the whistle is identical to a present art whistle. Air is blown into the mouthpiece 22 which is connected to the sound chamber 24 and emits an audible signal as it departs through the opening 26.

Initiation of the wireless output signal is by means of a sensor 12 which is responsive to the influx of said air. Said influx of air causes the diaphragm 40 to deflect, thereby actuating the switch 42. Said switch is electrically connected to the transmitter 18.

For the sake of brevity, a disclosure of the transmitter is omitted since that is a well-developed art with components readily available from suppliers of garage door openers, etc. A receiver 28, also well-developed, responsive to said wireless signal remotely initiates a variety of visual indicators such as a flash of light 32, the movement of an object 34, or an indication on a television screen 36.

CONCLUSION, RAMIFICATIONS, AND SCOPE

The objects are achieved by a modification to the present art referee whistle and the addition of a transmitter. The modification consists of a sensor that is integrally connected to the pneumatics of the whistle and senses that the whistle has been blown. The sensor is also electrically connected to a transmitter through wires that go with the lanyard that hangs from the referee's neck. By means of this connection, the sensor triggers circuitry within the transmitter to emit a wireless signal. An ON/OFF switch on the transmitter allows the referee to control whether or not a wireless signal should be generated.

A receiver responsive to the wireless isngal initiates a variety of visual indicators such as a flash of light, the movement of an object, or an indication on a television screen.

At a football game the flash of light could be located at the top of the goal posts, at the top of the first down markers, or on the scoreboard. At an indoor event, the flash could be located at the scorer's table or scoreboard. The movement of and object could be a flag that is released by the signal. It will now be possible for both the live audience and the television audience to know the precise instant that a referee's signal has been sounded.

The whistle can also be used as a starting signal for races. By triggering the flash of light, the hearing impaired will be able to readily sense the starting signal.

I claim:

1. A device for producing a plurality of official signals at a sporting event, wherein one of said official signals is an audio signal and at least one other official signal is a visual signal, comprising a conventional whistle that is responsive to the influx of air to produce said audio signal and the following:

a) a transmitter operatively associated with said whistle and responsive to an electrical impulse for transmitting a wireless output signal;

b) a sensor responsive to said whistle for generating said electrical impulse to said transmitter; and c) a receiver responsive to said wireless signal for generating a visual signal to spectators at a sporting event and to television viewers;

wherein said receiver controls generation of said visual signal located at the sporting event, and as well automatically controls generation of an said visual signal that is displayed on a televisions viewer's television screen, thereby indicating when the whistle is blown.

2. The device of claim 1 when the sensor is responsive to the audio output of the whistle and is attached to said whistle.

3. The device of claim 2 wherein the sensor is responsive to the influx of air into the whistle and is attached to said whistle.

4. The device of claim 2 wherein the sensor responsive to the audio output is separately located from said whistle.

5. The device of claim 1 wherein said receiver responds by causing indications to appear on scoreboards.

6. The device of claim 1 wherein said receiver responds by causing indications to appear on television screens.

* * * * *